United States Patent [19]

Brandis et al.

[11] Patent Number: 5,022,933

[45] Date of Patent: Jun. 11, 1991

[54] PROCESS FOR ANNEALING BORON-CONTAINING STEELS AND PRODUCT THEREOF

[75] Inventors: Helmut Brandis; Bernd Huchtemann; Peter Schuler; Dietrich Werner, all of Krefeld, Fed. Rep. of Germany

[73] Assignee: Thyssen Edelstahlwerke AG, Krefeld, Fed. Rep. of Germany

[21] Appl. No.: 421,590

[22] Filed: Oct. 16, 1989

[30] Foreign Application Priority Data

Oct. 22, 1988 [DE] Fed. Rep. of Germany ..... 3836102
May 26, 1989 [DE] Fed. Rep. of Germany ..... 3917071

[51] Int. Cl.[5] ..... C21D 1/26
[52] U.S. Cl. ..... 148/16; 148/330
[58] Field of Search ..... 148/16, 16.5, 330

[56] References Cited

U.S. PATENT DOCUMENTS 4,615,749 10/1986 Satoh ..... 148/330

FOREIGN PATENT DOCUMENTS 2126379 12/1972 Fed. Rep. of Germany .
2703149 4/1977 Fed. Rep. of Germany .
3312205 10/1983 Fed. Rep. of Germany .
60-128247 7/1985 Japan ..... 148/330
1435045 12/1976 United Kingdom .

OTHER PUBLICATIONS

Werner, "Steps in Annealing", *Bor-und borlegierte Stahle,* Boron and Boron Containing Steels, pp. 31, 32, 35.

*Primary Examiner*—Deborah Yee
*Attorney, Agent, or Firm*—Cushman, Darby & Cushman

[57] ABSTRACT

Boron-containing steel products having boron contents of up to 200 ppm are obtained by an annealing process in the temperature range of between 850° and 1050° C. The characterizing feature of the invention is that the products are annealed in the state of equilibrium in a non-oxidizing gaseous atmosphere with a boron potential supplied by a pulverulent boron oxide source having a value such that the products retain or adsorb their boron content. The boron source is quantitatively about 100 g of $B_2O_3$ per $m^3$ of annealing space. In an annealing gas atmosphere mainly consisting of hydrogen, the steam partial pressure can be adjusted at atmospheric pressure in the presence of $B_2O_3$ to the required boron activity within the range of between $10^{-3}$ to $10^{-5}$. The products can also be simultaneously case hardened during annealing. The case hardening agent can be mixed with pulverulent boron oxide as the boron source.

6 Claims, 1 Drawing Sheet

PROCESS FOR ANNEALING BORON-CONTAINING STEELS AND PRODUCT THEREOF

The present invention relates to boron-containing steels and to a process for annealing steel products having boron contents of up to 200 ppm in a temperature range of 850° to 1050° C.

BACKGROUND OF THE INVENTION

It is known to anneal steels containing up to 100 ppm boron in the dissolved form at an elevated temperature in the range around 1000° C. In this treatment, it has been observed repeatedly that the products are undesirably impoverished in boron, at least in the surface area. Thus, for example, T. Inoue and Y. Ochida described, in Lecture No. S. 1351, presented at the 102nd ISIJ Meeting 1981, that they had found, a boron impoverishment to a depth of up to 0.4 mm from the surface, after annealing of low-alloy steel containing 0.2% carbon and 30 ppm boron at 900° C. for 2 hours under flowing argon. The same result was obtained when annealing was performed in air instead or argon. They therefore recommended that boron-containing steels should be annealed in a vacuum of 13.3 mPa in the presence of a zirconium getter.

P. E. Busby, M. E. Warga and C. Wells reported in the Journal of Metals, November 1953, pp. 1463-8, that they had observed a simultaneous evaporation of carbon and boron from a low-alloy steel having 0.43% carbon and 38 ppm boron during wet hydrogen in annealings in the austenite range—i.e., above about 900° C.

In the Journal of Metals, February 1954, pp. 185-190 M. E. Nicholson reported that he had detected a fairly heavy enrichment of boron in the core of the samples, ascribing this to the formation of boron compounds. He recommended that, when adding boron, more particularly the oxygen content should be taken into account, since a portion thereof would combine with boron to form boron oxide, thus reducing the soluble proportion of boron having a hardenability-enhancing effect.

Frequently boron-containing steels exhibit very different hardenability. Since no systematic investigation has been carried out in this respect, the causal connection has hitherto remained unclarified.

Boriding is described in the specialist book "Boriding" by A. Graf von Matuschka (1977), published by Carl Hanser. Boriding processes are also known from German OS 2 126 379 and British Patent Specification 1,435,045.

SUMMARY OF THE INVENTION

Figure 1:
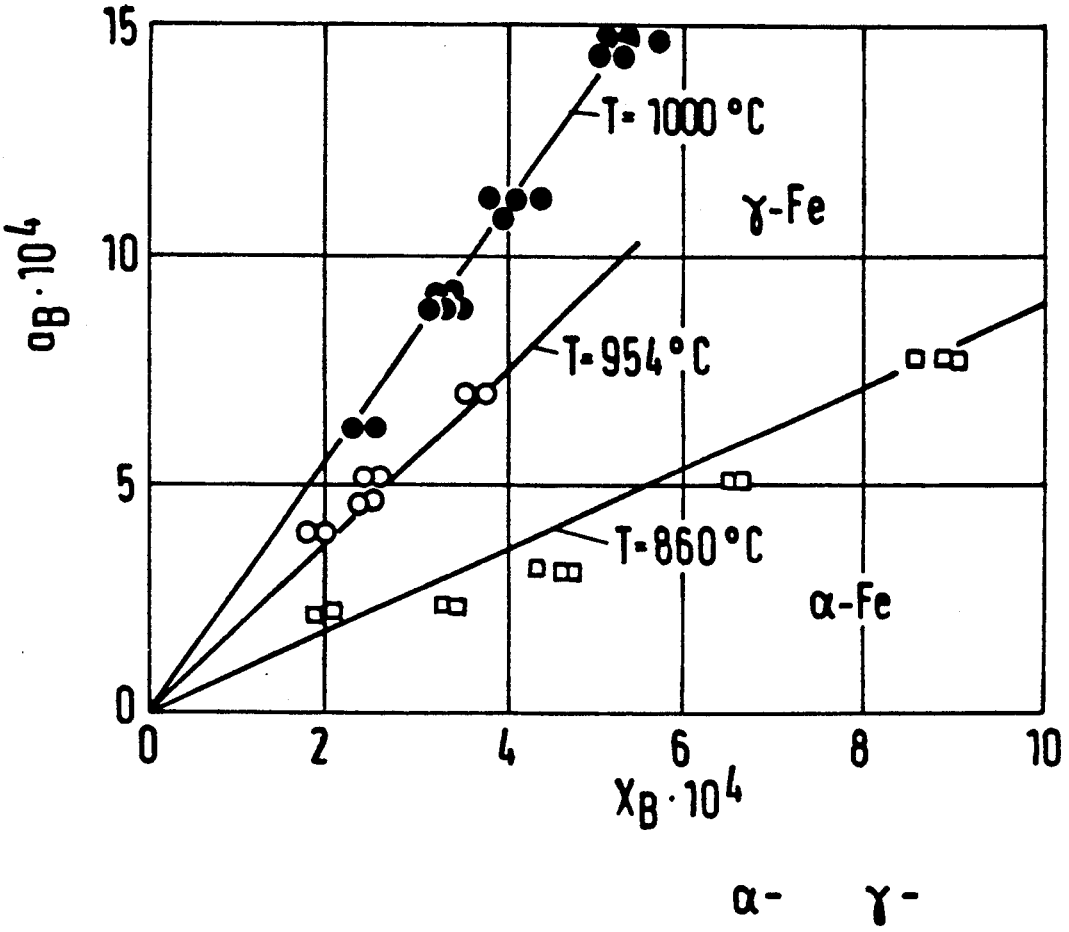
FIG. 1 is a graph showing the dependence of boron content on boron activity in alpha and gamma iron.

It is an object of the present invention to prevent boron from escaping during the high temperature annealing of steel products containing boron in the dissolved form, and to ensure that boron is even distributed in the steel in a well-defined, predeterminable quantity in the dissolved form, without a hard boride layer forming on the surface.

To this end, the invention provides boron-containing steels which, in the annealed condition, have a predefined (dissolved) boron content in the range of up to 200 ppm, and a process wherein the products are annealed in the state of equilibrium in a non-oxidizing gaseous atmosphere with a boron potential supplied by a pulverulent boron oxide ($B_2O_3$) source having a value which is sufficient that the products retain or absorb their boron content.

The process of the present invention is different from the known boriding of steels, wherein the boron activity in the annealing atmosphere is of a quite different order of magnitude, around or above 1, while in the process according to the invention it is lower by several orders of magnitude. Accordingly, during boriding, the steel absorbs boron contents in the % range—i.e., contents far above the solubility limit (in the case of gamma iron about 75 ppm B at 1000° C.) in the borided zone. Iron boride (FeB and $Fe_2B$) is formed.

In the process according to the invention, annealing is performed in the state of equilibrium—i.e., with constant temperature, pressure and concentration conditions, including constant boron activity and constant boron partial pressure in the annealing atmosphere. FIG. 1 shows clearly the dependence of the boron content on boron activity. It can be seen that the boron content increases in a temperature-dependent gradient with increasing boron activity and amounts to about 70 ppm boron in the case of gamma iron at 1000° C. with a boron activity $a_B=10^{-3}$, corresponding to a molar fraction of boron of $X_B=3.5\cdot10^{-4}$. The range of soluble boron activity, as shown in FIG. 1, therefore lies in the range of $10^{-3}$ to $10^{-4}$, while in boriding, as already mentioned, it is substantially higher. The process according to the invention is therefore aimed at the layer-free adjustment of a content of dissolved boron in the matrix, without the necessity of removing a hard boriding layer produced as a result.

As experiments have shown, the use of 100 g of $B_2O_3$ per m3 of annealing space as the boron source is adequate in conditions of equilibrium for the annealing, which takes several hours. The annealing conditions (pressure, temperature, composition of the annealing gas mixture) are adjusted, and then annealing is performed in the state of equilibrium, so that reproducible conditions are obtained.

If the annealing gas atmosphere mainly consists of hydrogen, in the presence of $B_2O_3$ the bore potential can be considerably reduced, since at the most traces of oxygen are still contained in the annealing gas atmosphere.

The neutral atmosphere also protects the steel against scaling and boron impoverishment. In a preferred embodiment of the process according to the invention it is recommended that the steam partial pressure in the $H_2$ annealing gas atmosphere is adjusted to the required boron activity and carefully measured, and if the steam partial pressure changes, it is regulated to the required value in the range of $10^{-3}$ to $10^{-5}$, since via the partial pressure relation derived from the formation equation of boron oxide $$a_B = \sqrt{K \cdot P_{H2O} - 3}$$

the boron activity $a_B$ in a pure hydrogen atmosphere depends solely on the steam partial pressure $P_{H2O}$ (K=constant). This provides the possibility of influencing the boron activity in the annealing gas atmosphere by altering the steam partial pressure.

Preferably, annealing is performed in the boron-containing gaseous atmosphere in the annealing box without circulation of the gaseous atmosphere, since, in that case, the annealing atmosphere can be prevented from being impoverished in boron by born oxide condensing out. Instead, the boron potential can remain preserved, even for hours, in the annealing gas atmosphere.

Contrary to the prevailing opinion (Nicholson loc. cit. and Grabke/Paju in: Steel Research 8/88, page 336), boron-containing products can also be case hardened by the process according to the invention, and even products from a steel containing no born can be case hardened and at the same time alloyed with soluble boron in a quantity of up to about 200 ppm boron.

Nicholson had succeeded in alloying iron, from an iron boride coating layer, with boron only when the sample was completely enclosed with boron powder during annealing in a hydrogen atmosphere. In contrast, in vacuo or using helium as a protective gas, boron could not be successfully diffused into an iron sample. Grabke/Paju (loc. cit.) only recently considered that the simultaneous carburization of steel and alloying up with boron was impossible.

The boron source, consisting of cheap pulverulent boron oxide, can be mixed with the case hardening agent in annealing with simultaneous carburization.

What is claimed is:

1. In a process for the annealing of steel products having boron contents of up to 200 ppm in the temperature range between 850° and 1050° C., the improvement in which the products are subjected to annealing in a state of equilibrium in a non-oxidizing gaseous atmosphere which has a boron potential supplied by a pulverulent boron oxide ($B_2O_3$) source having a value such that the products retain or absorb their boron content.

2. A process according to claim 1 in which 100 g of $B_2O_3$ are used per $m^3$ of annealing space.

3. A process according to claim 1 or claim 2 in which, in an annealing gas atmosphere mainly consisting of hydrogen, the steam partial pressure can be adjusted at atmospheric pressure in the presence of $B_2O_3$ to the required boron activity within the range of between $10^{-3}$ to $10^{-5}$.

4. A process according to claim 1 or claim 2 in which the products are case hardened during annealing.

5. A process according to claim 4 in which a case hardening agent is used, mixed with pulverulent boron oxide.

6. A product produced by the process of claim 1 or claim 2.

* * * * *